US009027751B2

(12) United States Patent
Lee

(10) Patent No.: US 9,027,751 B2
(45) Date of Patent: May 12, 2015

(54) TOOL BOX

(71) Applicant: Hong-Jen Lee, Taichung (TW)

(72) Inventor: Hong-Jen Lee, Taichung (TW)

( * ) Notice: Subject to any disclaimer, the term of this patent is extended or adjusted under 35 U.S.C. 154(b) by 7 days.

(21) Appl. No.: 14/010,575

(22) Filed: Aug. 27, 2013

(65) Prior Publication Data

US 2015/0060316 A1 Mar. 5, 2015

(51) Int. Cl.

| | |
|---|---|
| ***B25H 3/02*** | (2006.01) |
| ***E05D 1/02*** | (2006.01) |
| ***E05D 5/02*** | (2006.01) |
| ***A45C 13/28*** | (2006.01) |

(52) U.S. Cl.

CPC ..... *B25H 3/02* (2013.01); *B25H 3/023* (2013.01); *E05D 1/02* (2013.01); *E05D 5/023* (2013.01); *A45C 13/28* (2013.01)

(58) Field of Classification Search

CPC ..... B25H 3/023; B25H 3/02; B25H 3/021; B25H 3/025; E05D 1/02; E05D 5/023; A45C 13/28; E05Y 2900/602; B65D 43/166

USPC ..... 206/372, 373, 349, 379; 16/225, 383, 16/384; 220/842, 843

See application file for complete search history.

(56) References Cited

U.S. PATENT DOCUMENTS

| | | | | |
|---|---|---|---|---|
| 3,592,354 | A * | 7/1971 | Nielsen | 220/847 |
| 5,065,878 | A * | 11/1991 | Altmann et al. | 220/3.8 |
| 5,381,920 | A * | 1/1995 | Lin | 220/843 |
| 7,513,364 | B2 * | 4/2009 | Tsai | 206/379 |
| 8,016,153 | B2 * | 9/2011 | Boenig et al. | 220/847 |
| 8,573,715 | B1 * | 11/2013 | Jackman et al. | 312/34.4 |
| 2008/0047108 | A1 * | 2/2008 | Yu | 16/408 |

* cited by examiner

*Primary Examiner* — Sarah B McPartlin

(57) ABSTRACT

A tool box includes a first part, a second part and two connectors. Each of the first and second parts has multiple connection slots and at least one side. The connectors and the first and second parts are made by different materials. The two connectors each have two protrusions which are engaged with the connection slots. A connection plate is flexibly connected between two blocks of each of the connectors. The two blocks are connected to the first and second parts respectively. The first and second parts are pivotably connected to each other by the connection plates. Multiple connection pieces are connected between the connectors and the first and second parts, so as to secure the protrusions relative to the connection slots. The connectors are connected to the first and second parts.

6 Claims, 10 Drawing Sheets

TOOL BOX

FIELD OF THE INVENTION

The present invention relates to a tool box, and more particularly, to a tool box for receiving hand tools.

BACKGROUND OF THE INVENTION

The conventional metal tool box is disclosed in FIG. 14 and generally comprises a bottom part 71 and a top part 72, wherein the bottom part 71 has a space defined therein and a locking member 73 is located at the front side of the bottom part 71. The top and bottom parts 72, 71 are pivotably connected to each other at the two respective rear sides thereof. The top part 72 has a fixed member 74 on the front side thereof so that when the top part 72 is mounted onto the bottom part 71, the locking member 73 is hooked to the fixed member 74 to lock the tool box. The pivotal members on the rear sides of the conventional tool box include at least three pieces which involve a complicated structure. When the bottom part 71 is pivotably connected to the top part 72, a rivet is needed and this requires more assembling time and laboring cost. The connections between the locking member and the bottom part, the handle and the top part, and the fixed member and the top part each require riveting process, so that the manufacturing cost is increased. The metal tool box is made by way pressing and the shape of the tool box is generally made to be rectangular, the fixed shaped tool box cannot meet the aesthetic purposes and does not have multiple colors to be applied thereto.

The present invention intends to provide a tool box to improve the shortcomings mentioned above.

SUMMARY OF THE INVENTION

The present invention relates to a tool box and comprises a first part, a second part and two connectors. Each of the first and second parts has multiple connection slots and at least one side. The connectors and the first and second parts are made by different materials. The two connectors each have two protrusions which are engaged with the connection slots. A connection plate is flexibly connected between two blocks of each of the connectors. The protrusion is located on the protrusion corresponding thereto. The two blocks are connected to the first and second parts respectively. The first and second parts are pivotably connected to each other by the connection plates. Multiple connection pieces are connected between the connectors and the first and second parts, so as to secure the protrusions relative to the connection slots. The connectors are connected to the first and second parts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
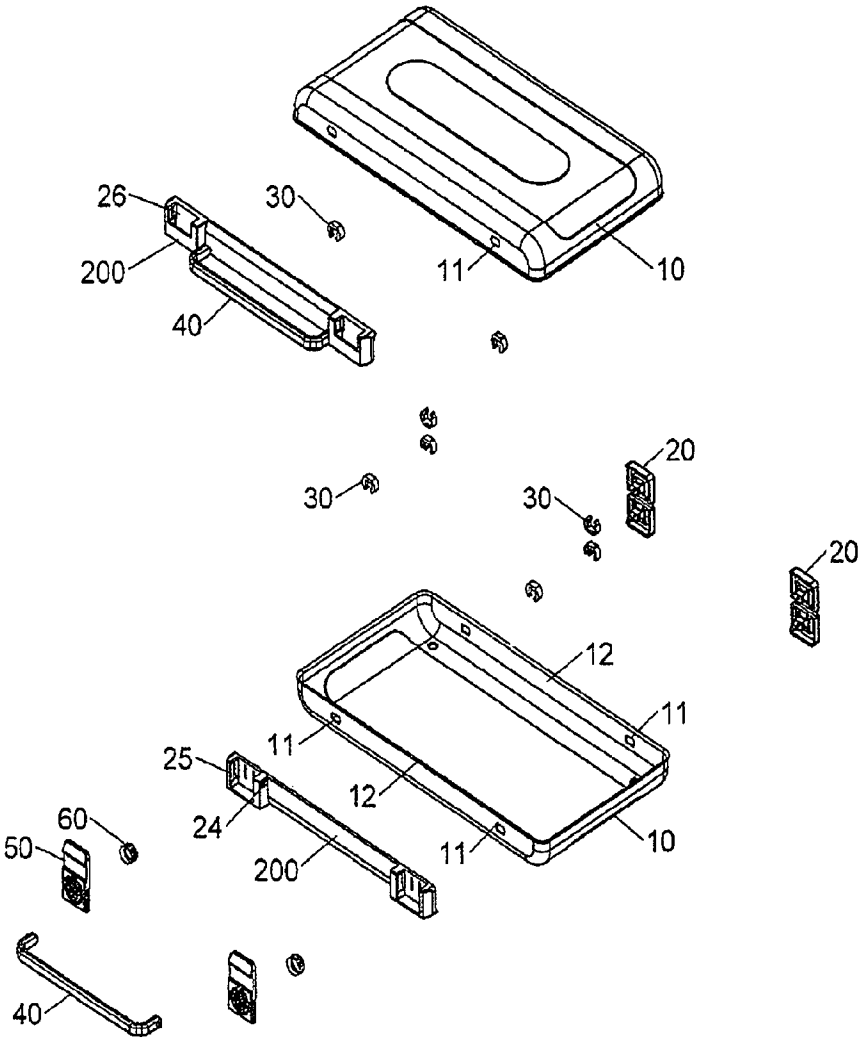
FIG. 1 is an exploded view to show the tool box of the present invention.
Figure 3:
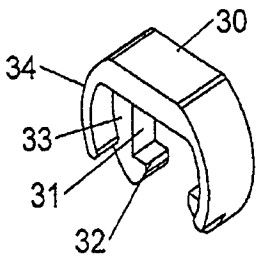
FIG. 3 is a perspective view to show the connection piece of the tool box of the present invention.
Figure 2:
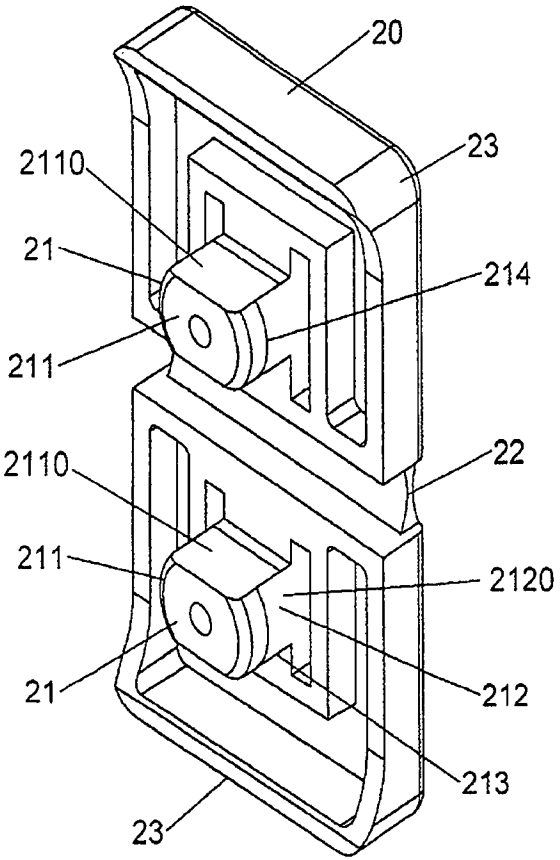
FIG. 2 is a perspective view to show the connector of the tool box of the present invention.
Figure 4:
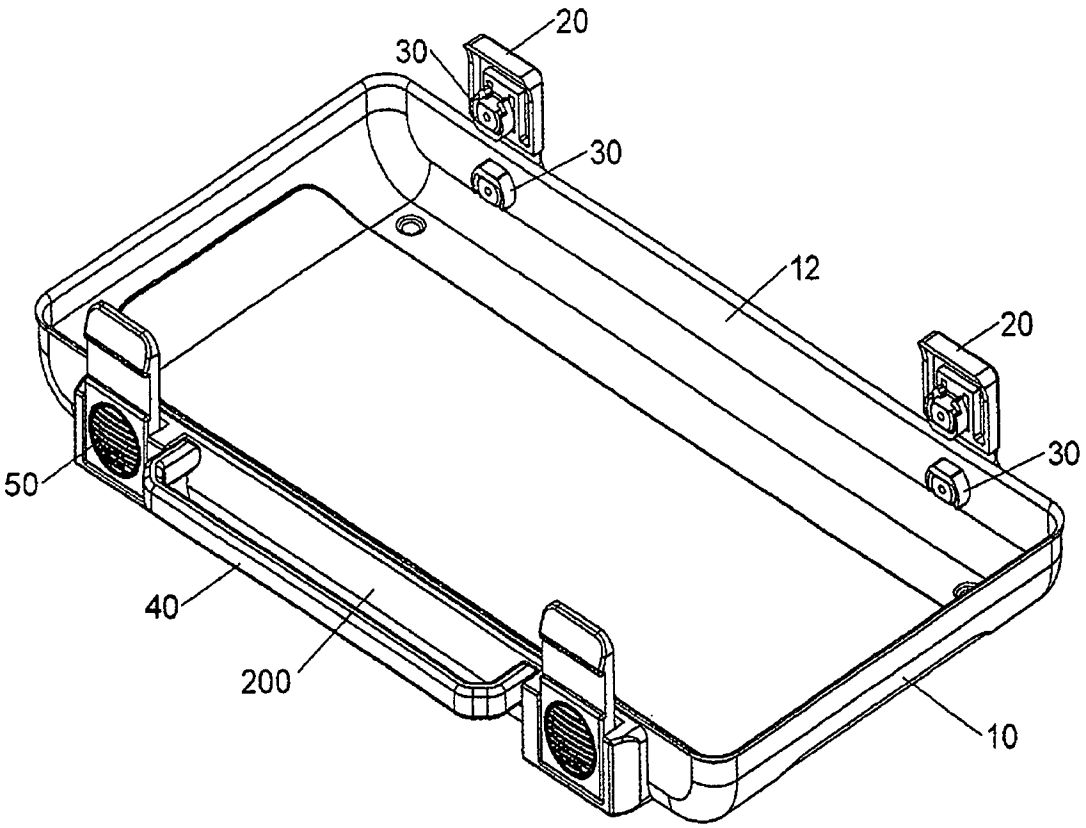
FIG. 4 is a perspective view to show the tool box of the present invention, wherein the top portion of the tool box is removed.
Figure 5:
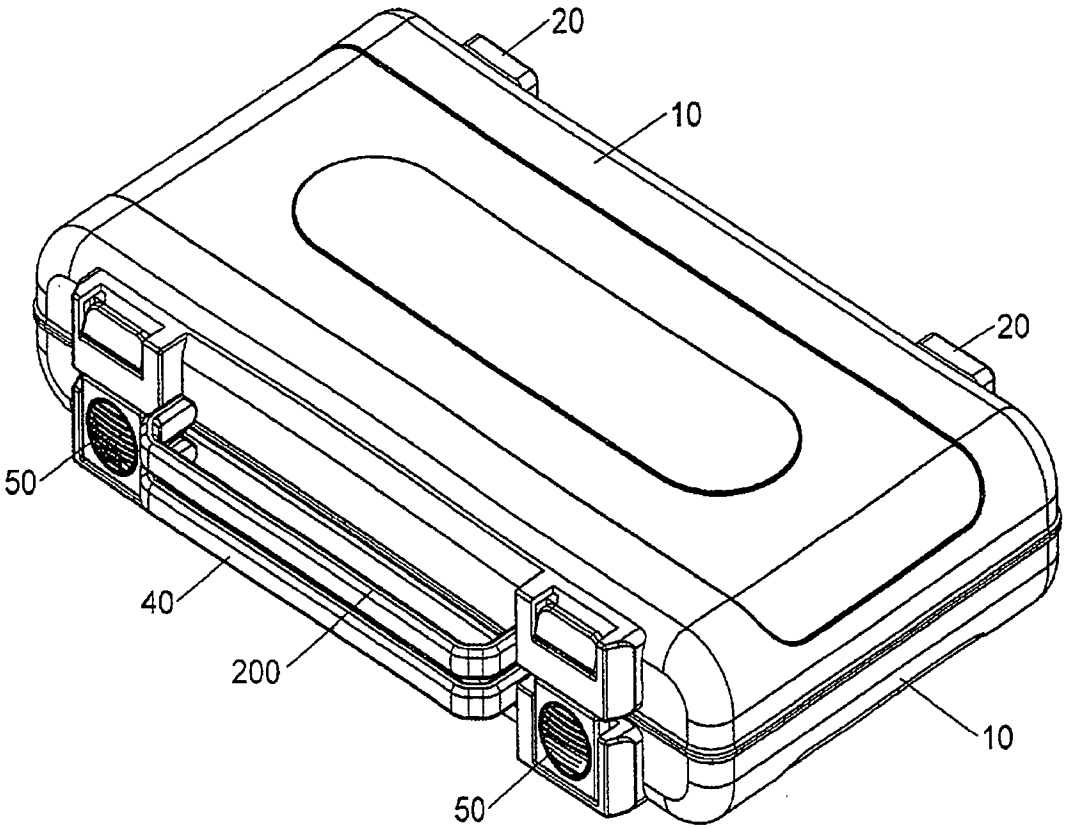
FIG. 5 is a perspective view to show the tool box of the present invention.
Figure 6:
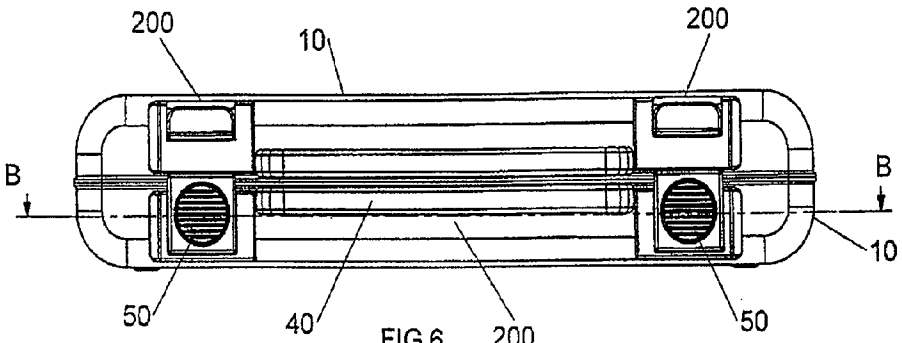
FIG. 6 is a front view of the tool box of the present invention.
Figure 7:
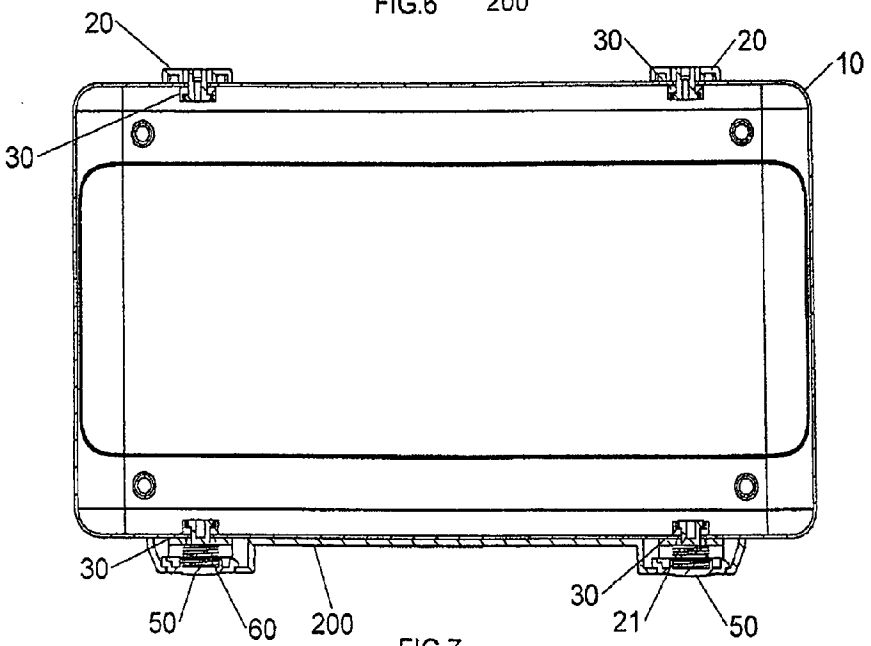
FIG. 7 is a cross sectional view, taken along line B-B in FIG. 6.

Referring to FIGS. 1 to 3, the tool box of the present invention comprises a first part 10, a second part 10, two connectors 20, multiple connection pieces 30, two handles 40, two locking members 50 and two resilient members 60. The first and second parts 10 are made by iron or aluminum and hand tools are received in the tool box. Each of the first and second parts 10 has four connection slots 11 defined therethrough, the connection slots 11 located close to four corners of each of the first and second parts 10. Each of the first and second parts 10 has at least two sides 12. There are two first connectors 20 and two second connectors 200 each are made by plastic or rubber. A connection plate 22 is connected between the two first connectors 20. Two blocks 23 are located on two ends of the connection plate 22 which can be bent so that the two blocks 23 are perpendicular to each other. Each block 23 has a protrusion 21 located thereon and the two protrusions 21 are engaged with the connection slots 11 of the first and second parts 10. Each protrusion 21 has a shank 212 which has a body 2110 and a distal end 211. The distal ends 211 each have two curved sides. The cross sectional area of the distal end 211 is larger than that of the body 2110 of the shank 212. The body 2110 of each shank 212 has two parallel surfaces 2120 and two first faces 213 which are perpendicular to the two parallel surfaces 2120. Two second faces 214 are connected between the distal end 211 and the body 2110 of the shank 212. The second faces 214 are located on two sides of the distal end 211. The two blocks 23 are respectively connected to the first and second parts 10. The two protrusions 21 are located symmetrically relative to the connection plate 22. The two blocks 23 are located symmetrically relative to the connection plate 22. The two second connectors 200 each are an elongate member and have two protrusions 21 respectively located on two ends thereof. One of the two second connectors 200 has two pivotal portions 24 which are located symmetrically to each other. Each of the pivotal portions 24 is a hole. Two first slots 25 are respectively defined through two ends of the second connector 200 that has the two pivotal portions 24. The two first slots 25 are located close to the two pivotal portions 24 respectively. The other second connector 200 has two second slots 26, each of the second slots 26 is located in alignment of one of the two first slot 25.

There are eight connection pieces 30 and each connection piece 30 is a C-shaped connection piece and has a mounting portion 31 which is mounted to the shank 212. Two hooks 32 extend perpendicularly from two distal ends of the mounting portion 31. The hooks 32 are hooked with the first faces 213 of the connector 20. The mounting portion 31 has contact faces 33 which are in contact with the second faces 214. The protrusions 21 of the connectors 20 are engaged with the connection slots 11 of the first and second parts 10. The connection pieces 30 are connected between the distal ends 211 and the sides 12 to secure the protrusions 21 relative to the connection slots 11. The connectors 20 connected to the first and second parts 10.

The two handles 40 each are a U-shaped handle and have two ends which are pivotably connected to the pivotal portions 24. The two locking members 50 each are connected between the first slot 25 and the second slot 25, 26 of the two second connectors 200. When the locking members 50 are disengaged from the second slots 26, the first and second parts 10 can be opened. The two resilient members 60 each are connected between the locking member 50 and the first slot 25, the resilient members 60 bias the locking members 50 to be engaged with the second slots 26.

As shown in FIGS. 4 to 7, the four protrusions 21 of the two connectors 20 are engaged with the four connection slots 11 of the first and second parts 10, and the connection pieces 30 are in contact between the sides 12 and the distal ends 211, so that the protrusions 21 are secured in the connection slots 11. The two connectors 20 are connected to the first and second parts 10. The handles 40 are connected to the pivotal portions 24. The two locking members 50 extend through the first and second slots 25, 26. The two resilient members 60 are located between the first slots 25 and the two locking members 50.

Figure 9:
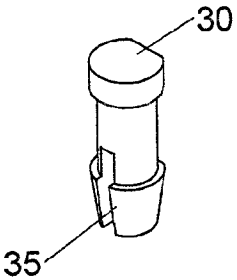
FIG. 9 is a perspective view to show the second embodiment of the connection piece of the tool box of the present invention.
Figure 8:
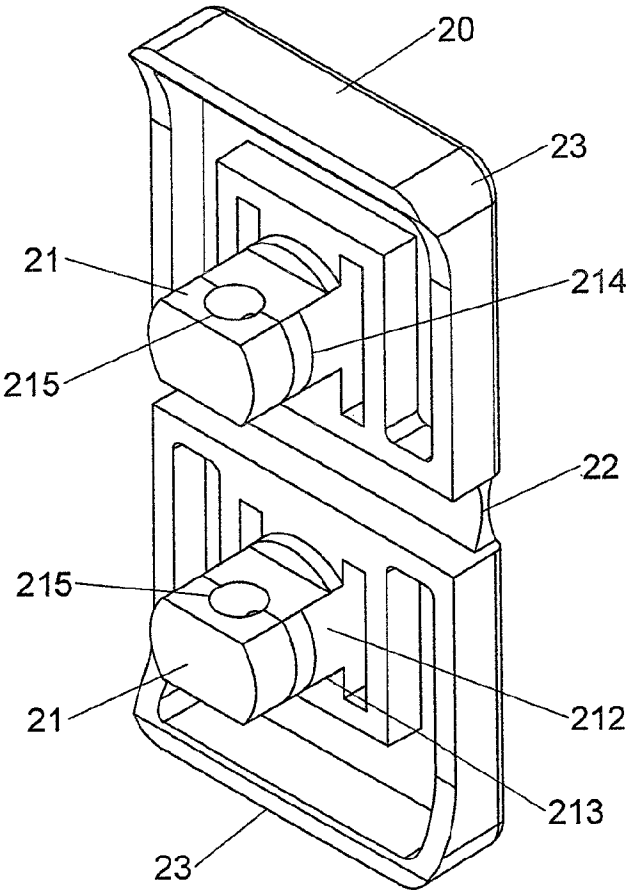
FIG. 8 s a perspective view to show the second embodiment of the connector of the tool box of the present invention.

As shown in FIGS. 8 and 9, the second embodiment of the connector 20 wherein the protrusion 21 does not have the distal end 211, the shank 212, the first face 213 and the second face 214. Each of the protrusions 21 has a passage 215. The connection pieces 30 each are shaped to match with the passages 211. Each of the connection pieces 30 has an engaging portion 35. The cross sectional area of the distal end and the engaging portion 35 of the connection piece 30 is larger than that at the middle portion of the connection piece 30. The connection pieces 30 extend through the passages 215 of the connectors 20. An end face of each of the connection pieces 30 contacts the sides 12 of the first/second part 10. The protrusions 21 are engaged with the connection slots 11 and the connectors 20 are connected to the first and second parts 10.

Figure 11:
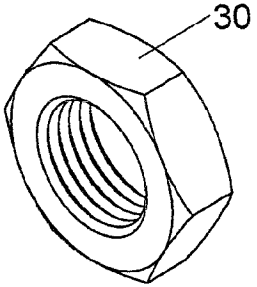
FIG. 11 is a perspective view to show the third embodiment of the connection piece of the tool box of the present invention.
Figure 10:
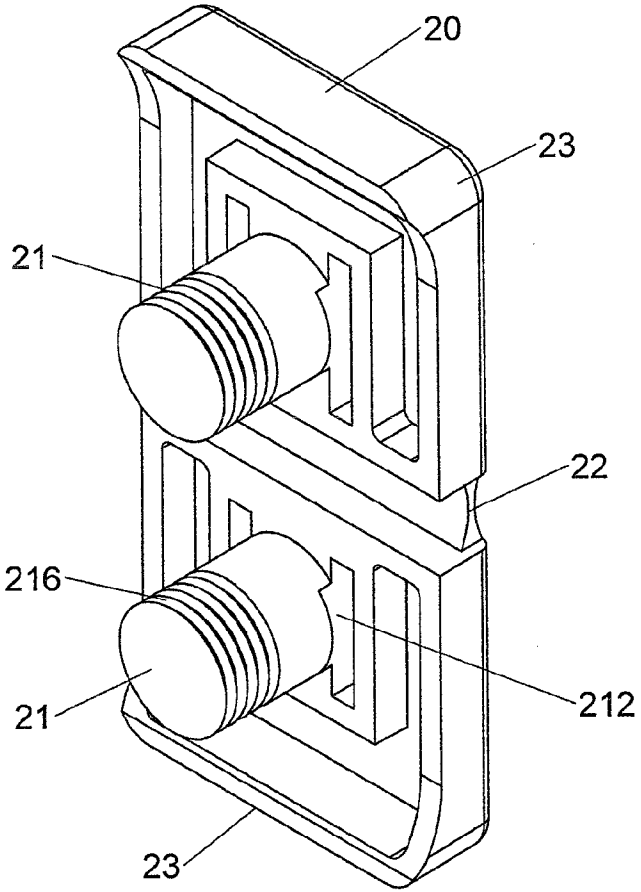
FIG. 10 is a perspective view to show the third embodiment of the connector of the tool box of the present invention.

As shown in FIGS. 10 and 11, each of the protrusions 21 is a cylindrical protrusion and threads 216 are formed on the distal end of each protrusion 21. The connection pieces 30 are nuts which are threadedly connected to the threads 216. The protrusions 21 of the connectors 20 are engaged with the connection slots 11. The connection pieces 30 contact the sides 12 of the first/second part 10, and the connectors 20 are connected to the first and second parts 10.

Figure 12:
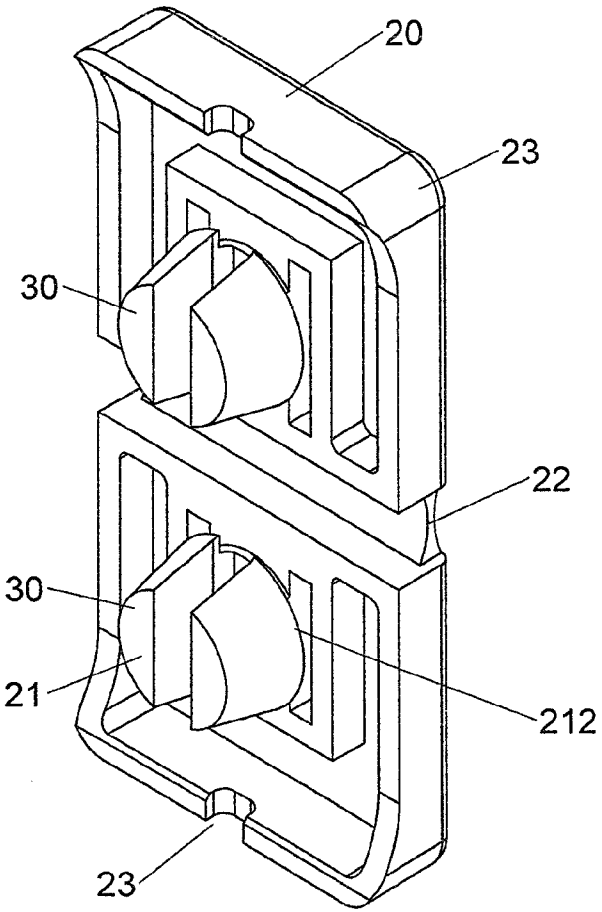
FIG. 12 is a perspective view to show the fourth embodiment of the connector of the tool box of the present invention.
Figure 13:
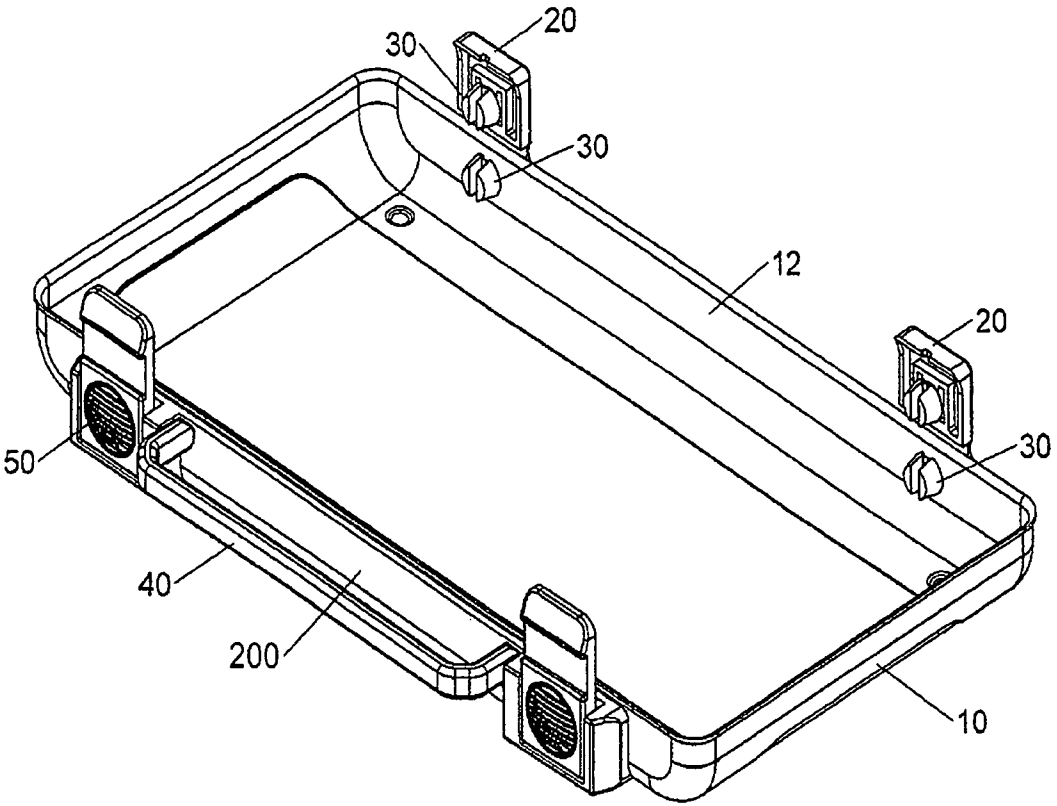
FIG. 13 is a perspective view to show the fourth embodiment of the tool box of the present invention, wherein the top portion of the tool box is removed.
Figure 14:
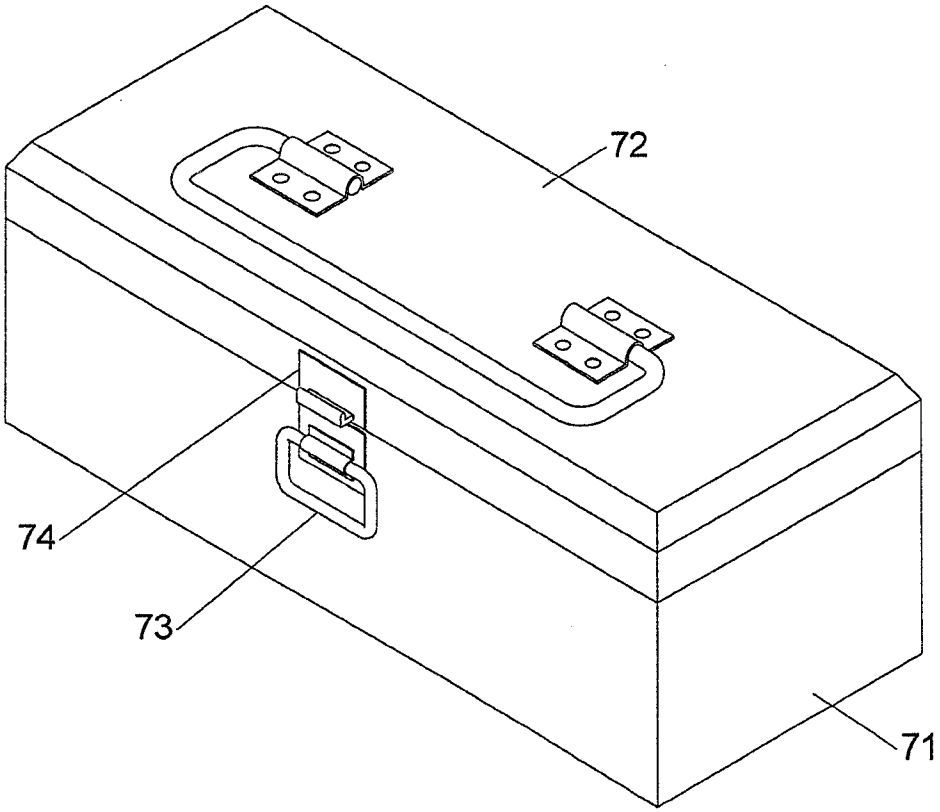
PRIOR ART FIG.14
FIG. 14 shows the conventional tool box.

As shown in FIGS. 12 and 13, the protrusions 21 and the connection piece 30 are formed as a one-piece. The connection piece 30 has an inclined surface which is connected with the distal end of the protrusion 21. The connection piece 30 is pushed into the connection slot 11, and the connection piece 30 contacts the side 12. The connectors 20 are connected to the first and second parts 10.

The tool box is made by metal such as iron or aluminum, and has a certain thickness so that the tool box has better structural strength.

The connectors 20 are made by plastic or rubber. The connectors 20 and the connection pieces 30 can be connected by different ways. The connection is easy and the number of parts is less than the conventional tool box, so that the manufacturing cost is reduced.

The connectors 20 have the connection plates 22 to which the first and second parts are pivotably connected to each other. The connection plates 22 are made by plastic which is less expensive.

When the connection plates 20 are worn out, the connection pieces 30 are removed from the tool box and the connection plates 20 can be easily replaced.

The first and second parts are connected by four connectors 20 which are made by plastic which can be different colors to increase the attractiveness of the tool box.

The connectors 20 have different types as shown in FIG. 1 and each connector 20 has protrusions 21 which are connected to the first and second parts so that the assembling is quick and easy.

Other accessories can be easily connected to the tool box if the accessories have protrusions 21 which can be connected to the tool box by the connection pieces 30. The tool box may be connected different accessories.

While we have shown and described the embodiment in accordance with the present invention, it should be clear to those skilled in the art that further embodiments may be made without departing from the scope of the present invention.

What is claimed is:

1. A tool box comprising:

a first part and a second part, each of the first and second parts having multiple connection slots defined therethrough, the connection slots located close to four corners of each of the first and second parts, each of the first and second parts having at least two sides;

two first connectors and two second connectors each being made by plastic or rubber, the two first connectors each having two protrusions, each protrusion engaged with one respective connection slot of the first and second parts, each protrusion having a shank which has a body and a distal end, a cross sectional area of the distal end being larger than that of the body, the body of each shank having two parallel surfaces and two first faces which are perpendicular to the two parallel surfaces, two second faces connected between the distal end and the body, the second faces located on two sides of the distal end, two blocks located on two ends of a connection plate which is bent so that the two blocks are perpendicular to each other, each protrusion located on one of the blocks, the two blocks connected to the first and second parts respectively, the two protrusions being located symmetrically relative to the connection plate, the two blocks being located symmetrically relative to the connection plate, the two second connectors each being an elongate member and having two protrusions respectively located on two ends thereof, one of the two second connectors having two pivotal portions which are located symmetrically to each other, each of the pivotal portions being a hole, two first slots respectively defined through two ends of the second connector having the two pivotal portions, the two first slots located close to the two pivotal portions respectively, the other second connector having two second slots, each of the second slots being located in alignment of one of the two first slots of the second connector having the two pivotal portions, and eight connection pieces each being a C-shaped connection piece and having a mounting portion which is mounted to one of the shank, two hooks extending perpendicularly from two distal ends of the mounting portion, the hooks being hooked with the first faces of the body of the shank, the mounting portion having contact faces which are in contact with the second faces, the protrusions of the connectors being engaged with the connection slots of the first and second parts, the connection pieces connected between the distal ends and the sides to secure the protrusions relative to the connection slots, the connectors connected to the first and second parts.

2. The tool box as claimed in claim 1, wherein the first and second parts are made by iron or aluminum.

3. The tool box as claimed in claim 1, wherein the second faces of each distal end are curved faces.

4. The tool box as claimed in claim 1, wherein the connection pieces each have an outer portion which is mounted to the distal end.

5. The tool box as claimed in claim 1 further comprising two handles and each handle is a U-shaped handle and has two ends which are pivotably connected to the pivotal portions of a corresponding one of the second connectors.

6. The tool box as claimed in claim 1 further comprising two locking members and each of the locking members is connected between one of the first slots and a corresponding one of the second slots, when the locking members are disengaged from the second slots, the first and second parts are opened, two resilient members each being connected between the locking member and the first slot, the resilient members bias the locking members to be engaged with the second slots.

* * * * *